United States Patent [19]

Barge

[11] 4,454,776

[45] Jun. 19, 1984

[54] ELECTRIC CONTROL DEVICE FOR ACTUATING MEANS

[75] Inventor: Jean Barge, Montbeliard, France

[73] Assignee: Aciers et Outillage Peugeot, Audincourt, France

[21] Appl. No.: 318,892

[22] Filed: Nov. 6, 1981

[30] Foreign Application Priority Data

Feb. 18, 1981 [FR] France ..... 81 03169

[51] Int. Cl.[3] ..... G05G 17/00

[52] U.S. Cl. ..... 74/2; 74/3.5; 185/40 R; 200/40; 292/201

[58] Field of Search ..... 74/2, 3.5; 185/40 R; 200/40; 251/71; 292/201, 144; 318/380

[56] References Cited

U.S. PATENT DOCUMENTS 3,919,611 11/1975 Takahashi et al. ..... 318/380
4,252,351 2/1981 Yoshino et al. ..... 292/201 X
4,290,634 9/1981 Gelhard ..... 292/201

FOREIGN PATENT DOCUMENTS 2439284 5/1980 France .

*Primary Examiner*—Allan D. Herrmann

*Attorney, Agent, or Firm*—Sughrue, Mion, Zinn, Macpeak and Seas

[57] ABSTRACT

The device controls an actuating device having a linear displacement and a sudden action, for example a device actuating a latch. The actuating device is disposed in a case provided with an aperture through which it is capable of emerging under the action of a spring after the release of a locking device until it abuts against an element connected to the case. Provided inside the case is a wheel actuated by an electric motor and a device for driving under the action of the wheel the displacement of the actuating device in opposition to the action of the spring at least until the return movement of the actuating device is locked by the locking device. A device is also provided in the case for unlocking the locking device upon the subsequent rotation of the wheel. A device is provided in the case for interrupting the supply of current to the motor and consequently stopping the rotation of the wheel after the locking of the operating device by the locking device but before the unlocking of the locking device. A device is provided which is connected to a control element for re-establishing the supply of current to the electric motor and consequently the rotation of the wheel.

8 Claims, 12 Drawing Figures

ELECTRIC CONTROL DEVICE FOR ACTUATING MEANS

DESCRIPTION

The present invention relates to an electric control device for actuating means having a linear displacement and a sudden action and in particular for means actuating a latch such as that described in French Pat. No. 2 439 284.

In this patent, a latch has been described for a vehicle door which comprises means for actuating a lever adapted to release the mechanism of the latch. This actuating means is rigid with the movable armature of an electromagnet which controls its linear movement. Such an electromagnet is, on one hand, space consuming and, on the other hand, implies a strong demand of current and is consequently not fully satisfactory.

An object of the present invention is to provide an electric control device for such an actuating means which is small in overall size and does not imply a large demand of current but, on the contrary, permits both a progressive accumulation of energy and a sudden release of this energy.

For this purpose, the invention provides an electric control device for an actuating means having a linear displacement and a sudden action, wherein the actuating means is disposed in a case provided with an aperture through which aperture it is capable of emerging under the action of a spring after the release of locking means, until it abuts against an element connected to the case and there is provided inside said case a wheel actuated by an electric motor, means for driving under the action of the wheel the displacement of the actuating means in opposition to the action of the spring at least to the locking of the return movement of the actuating means by said locking means, means for unlocking said locking means upon the subsequent rotation of the wheel, means for interrupting the supply of the electric motor and consequently stopping the rotation of the wheel after the locking of the actuating means by said locking means, but before the unlocking of said locking means, means connected to a control means being provided for re-establishing of the supply of current to the electric motor and consequently the rotation of the wheel.

This device permits a progressive accumulation of the amount of energy required for the action. This energy is released only when the control means is acted upon. This release occurs suddenly when the device again accumulates the amount of energy required for the following acutation.

Indeed, once the acutating means is released, the wheel continues its rotation and progressively returns the actuating means to the locking position, then the motor and the wheel stop and the device is thus armed and awaits the following command.

The invention will be explained hereinafter in more detail with reference to the drawings which represent solely one embodiment illustrating by way of example an electric control device for controlling the opening of a latch of a vehicle such as described in French Pat. No. 2 439 284.

Figure 1:
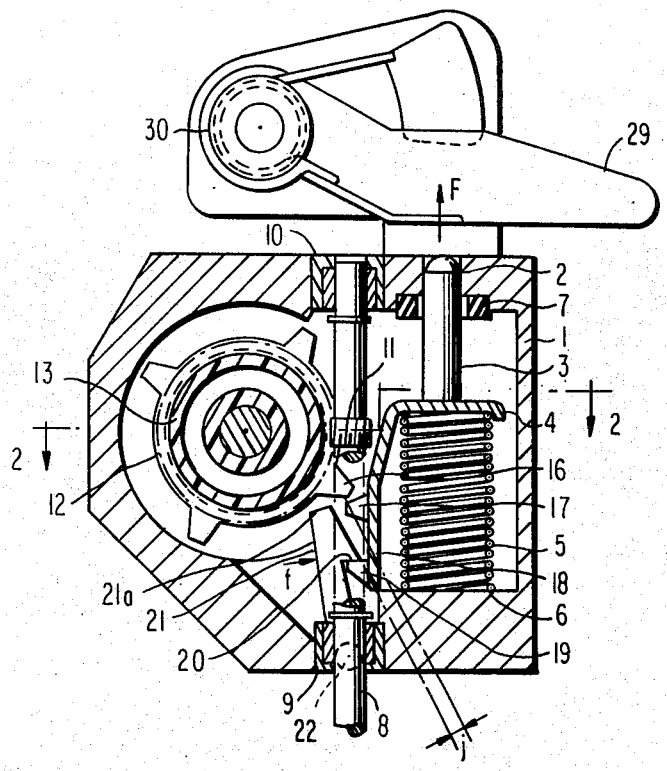
FIG. 1 is a side elevational and sectional view of the device according to the invention.
Figure 2:
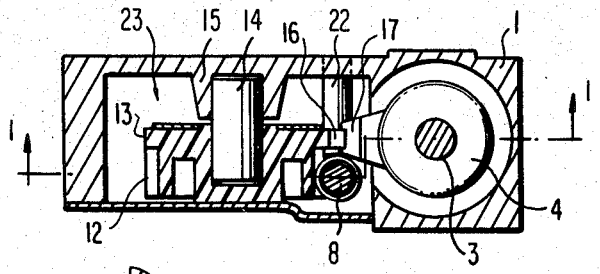
FIG. 2 is a sectional view taken on line 2—2 of FIG. 1.

The device shown in FIG. 1 comprises a case 1 provided with a cylindrical opening 2 with vertical walls in which a cylindrical striker 3 is slidable. The striker 3 comprises a larger cylindrical base 4 in the form of an inverted cup which caps a coil spring 5. The spring 5 moreover is supported on a base 6 rigid with the case 1 and upwardly biases the striker 3 until the base 4 encounters an elastically yieldable stop 7 mounted on the case 1 and surrounding the base of aperture 2.

The case 1 has extending therethrough a vertical shaft 8 which is journalled in two bearings 9 and 10 fixed to the case. This shaft is driven in rotation by an electric motor M having a field constituted by permanent magnets diagrammatically shown in FIG. 3. The shaft carries inside the case a worm 11. The latter is engaged with a worm wheel 12 disposed laterally on a wheel 13 which is journalled on a horizontal shaft 14. The shaft 14 is fixed within an annular rib 15 rigid with the case 1. By way of a modification, the shaft 14 may be movable with respect to the case and the wheel fixed on the shaft 14.

In the illustrated embodiment, the wheel 13 has four teeth such as 16, which are evenly spaced apart and disposed on the periphery on the wheel on a part of the wheel adjacent to that carrying the worm wheel 12.

The teeth 16 each cooperate in turn with a tooth 17 which has an extension 18 rigid with the base 4 of the striker 3 and disposed laterally along the spring 5.

The tooth 17 is disposed in such manner that when the striker 3 is in the upper position, a tooth, such as 16, engages the tooth 17 and causes the displacement of the striker 3 to a lower position in which it releases it. The profile of the teeth 16 and 17 which cooperate with each other are conjugate profiles, for example of the standard involute type for the tooth 16 and rack type for the tooth 17.

The extension 18 has moreover under the tooth 17 a lug 19 against which becomes hooked just before the striker is in the lower position, the hooking nose 20 of a pawl 21 movable on a horizontal shaft 22 disposed in the bottom of the case 1. This pawl 21 is constantly biased in the direction of arrow f by a return spring (not shown). Further, the lower surface of the lug 19 has an inclined profile so as to urge back the inclined hooking nose 20 of the pawl 21 when the striker is driven downwardly until the return spring bias f places the pawl in the position thereof for hooking on the lug 19 of the striker 3. The head 21*a* of the pawl 21 is disposed in such manner as to be in the path of the tooth 16 of the wheel 13 so that the tooth 16 urges the pawl back upon the subsequent rotation of the wheel.

Figure 3:
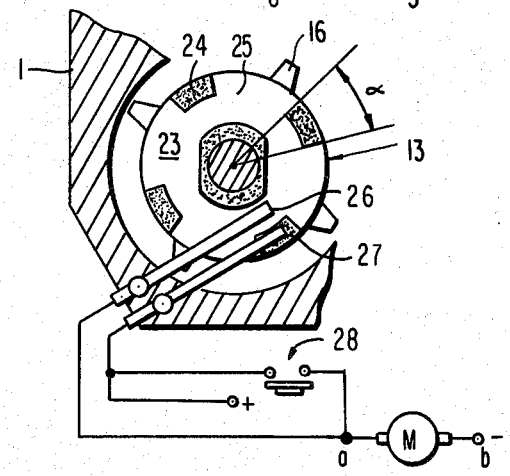
FIG. 3 is a rear elevational view of the device shown in FIG. 1.

The wheel 13, which is of an electrically insulating material (for example a moldable plastics material), has, as shown in FIG. 3, on the side 23 adjacent the teeth 16, four bosses 24 which are evenly spaced apart on the periphery of the wheel and are defined by annular sectors of an angle $\alpha$, the periphery of the wheel and a concentric circle.

An electrically conductive annular plate 25 comprising notches fitting the bosses 24 and having a thickness equal to the height of the bosses 24 is fixed on the side 23 for example by a clipping arrangement.

As shown in FIG. 3, two electric brushes respectively 26 and 27 are fixed on the case 1 and electrically insulated therefrom. These brushes are formed by spring strips in a single-piece or having attached end portions which are disposed parallel to each other. The brush 26 is in contact with the plate 25 in the centre zone of the annular plate 25 whereas the brush 27 is in contact with the annular plate in the vicinity of the periphery thereof and ceases this contact when it is located on a boss 24. The brushes 26 and 27 are disposed in such manner that the brush 27 engages a boss 24 when the striker 3 is in the lower position.

The brush 27 is electrically connected, on one hand, to the + terminal of the electric supply source and, on the other hand, to one of the terminals of the motor through a switch 28 the closure of which is controlled by a push-button.

The brush 26 is electrically connected to the same terminal of the motor as the brush 27, the other terminal of the motor being connected to the − terminal of the supply.

The device operates in the following manner:

Sequence A: awaiting an order (FIGS. 1 and 3).

The brush 27 bearing on a boss 24 is not electrically connected to the brush 26 and the motor M, which is consequently not supplied with current, is stationary.

In this position, the spring 5 is compressed and the pawl 21 retains the striker 3.

A tooth 16 of the wheel 13 is stationary in front of the head of the pawl 5 at a distance j which allows the subsequent starting up of the motor under no load.

Sequence B: order to open.

The user depresses the push-button of the switch 28. This closure then ensures the direct supply of current to the motor which starts up and rotates the wheel 13.

The duration of impulse of the push-button permits the brush 27 to leave the boss 24 and come in contact with the annular plate 25 and therefore transmits its polarity to the brush 26 and consequently to the motor M. The motor M is thus self-supplied and the push-button of the switch 28 can be released.

The motor thus conserves its supply and permits the following sequences to occur (until the brush 27 again encounters the following boss).

Figure 4A:
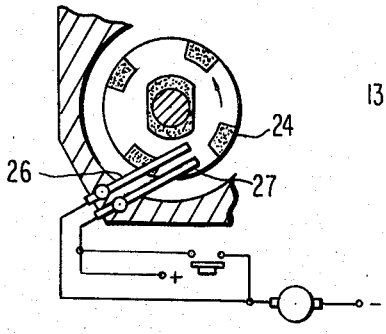
FIGS. 4 and 4A, 5 and 5A, 6 and 6A are views respectively similar to the views 1 and 3 which represent the various stages of operation.
Figure 4:
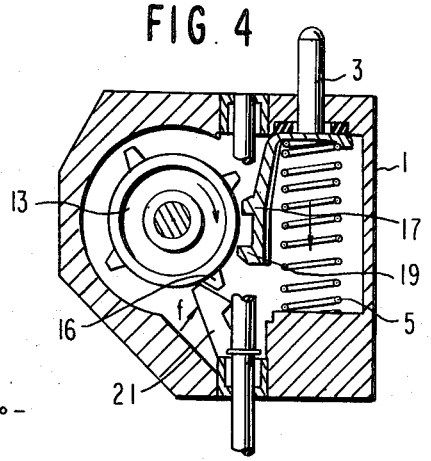

Sequence C: opening (FIGS. 4 and 4A).

The tooth 16 of the wheel 13 in front of the pawl 21 urges back the latter. The striker 3 is suddenly released. The spring 5 extends and shifts the striker 3 in the direction of arrow F (FIG. 1). The lever 29 (shown in FIG. 1) is then rotated about a shaft 30 and the latch is unlocked. The force exerted by the striker 3 on the lever 29 is a direct function of the force exerted by the spring and the mass of the striker. The elastically yieldable stop 7 absorbs the end-of-travel energy and avoids impact of the striker 3 on the case and thus reduces the operating noise.

Figure 5A:
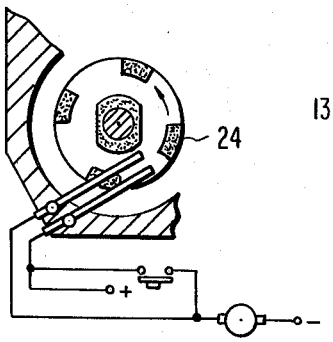
Figure 5:
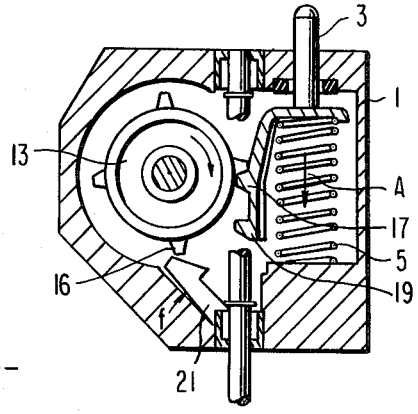

Sequence D: start of the arming (FIGS. 5 and 5A).

The tooth 16 of the wheel 13 which urged back the pawl 21 is still in contact with the latter and continues to urge it back in opposition to the action of the return spring. The tooth 16 immediately following on the tooth which urged back the pawl 21 comes in contact with the tooth 17 on the striker 3 and drives it in the direction $\vec{A}$. The spring 5 starts to be compressed.

Figure 6A:
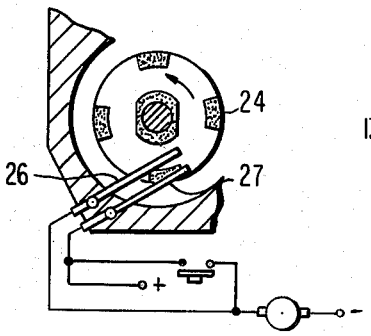
Figure 6:
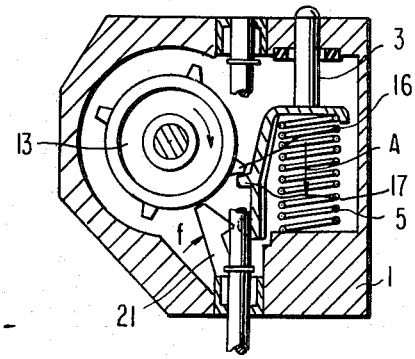

Sequence E: end of the arming and stoppage (FIGS. 6 and 6A).

The wheel 13 continues to rotate. The pawl 21 escapes from the tooth 16, the striker 3 is still driven in the direction $\vec{A}$ and progressively compresses the spring 5.

Under the action of the return spring bias f the pawl 21 is urged back until it comes in contact with the lower surface of the lug 19 whose slope causes the pawl 21 to withdraw until it is capable of engaging on the upper part of the lug 19. The hooking has thus been achieved.

The brush 27 engages at the same amount on a boss 24 and thus interrupts the supply of current to the motor and consequently interrupts the rotation of the wheel 13.

The device has returned to a position in which it awaits a new order.

Each boss 24 must have an annular extent $\alpha$ which is such that it allows the stoppage of the wheel 13, i.e. before the brush 27 can again come in contact with the annular plate 25, since, owing to the kinetic energy stored in the rotating elements, (field of the motor mainly), the stoppage is not normally instantaneous.

Further, this angular width $\alpha$ must be as small as possible so that the brush 27 can resume contact with the annular plate 25 during the brief depression on the push-button of the switch 28.

It is consequently advantageous to add to the supply circuit of the motor an instantaneous stopping device. Such a device may comprise a system for shorting the terminals of the motor when the supply is interrupted. It is known that an electric motor having a field formed by permanent magnets then stops instantaneously.

Figure 7:
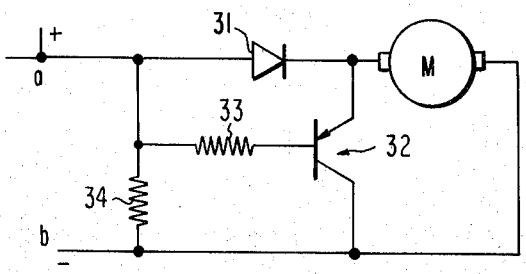
FIG. 7 is an electric diagram of an instantaneous motor stopping device.

FIG. 7 shows a diagram of such a device. This device is disposed between the points a and b shown in FIG. 3 which are respectively connected to the + terminal (through the circuit shown in FIG. 3) and to the − terminal.

The point a is connected to one of the terminals of the motor M through a diode 31 and the point b is directly connected to the other terminal of the motor. The emitter of a transistor 32 is connected to the junction point of the diode 31 and the terminal of the motor and the collector of this transistor is connected to the point b. A resistor 33 of value $R_1$ connects the base of the transistor 32 to the point a and a resistor 34 of value $R_2$ connects the point a to the point b.

When the motor is supplied between a (+) and b (−), the transistor 32 is "blocked" since the emitter and the base have the same potential +.

When the supply is cut off at a (+), the motor continues to rotate under the effect of inertia and becomes a generator.

The diode 31 precludes any return of current.

The emitter of the transistor 32 being at potential + and its base at a potential − (since there is no longer any supply at a), this transistor becomes conductive and the terminals of the motor are shorted and cause the motor to stop immediately.

For example, in respect of a motor of 50 to 60 effective W, the following components may be employed:

diode of type 2 N 4004, transistor of type BDW 93

$R_1 = 200\ \Omega$ $R_2 = 1000\ \Omega$

Figure 8:
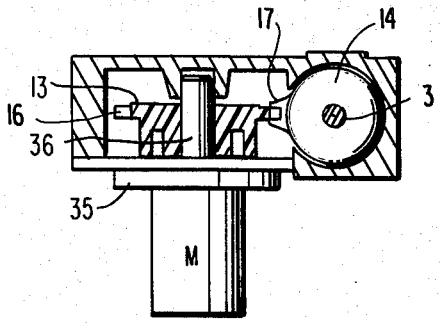
FIGS. 8 and 9 are sectional views similar to FIG. 2 of modifications of the driving device.
Figure 9:
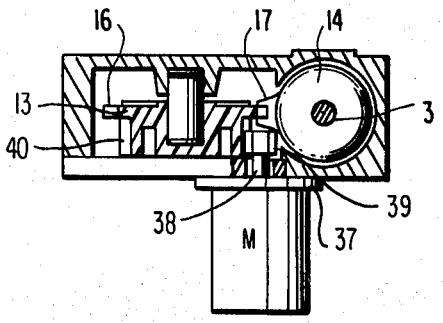

Modifications of the device for driving the wheel 13 are shown in FIGS. 8 and 9.

The device shown in FIG. 8 comprises a motor M whose axis is parallel to the axis of the wheel 13. This motor is associated with a speed reducer 35 whose output shaft 36 carries the wheel 13.

The device shown in FIG. 9 comprises a motor M whose axis is also parallel to the axis of the wheel 13. The motor is associated with a speed reducer 37 whose output shaft 38 carries a gear pinion 39 which meshes with a gear pinion 40 carried by the wheel 13.

Having now described my invention what I claim as new and desire to secure by Letters Patent is:

1. An electric control device for an actuating means having a linear displacement and a sudden action, comprising a case, the acutating means being disposed in the case, which case defines an aperture through which aperture the actuating means is capable of emerging, a spring cooperative with the actuating means for causing the actuating means to emerge from said aperture and abut an element connected to said case, locking means cooperative with said actuating means for retaining said actuating means against the action of said spring, a rotatable wheel mounted inside said case, an electric motor drivingly connected to said wheel, a power supply, a circuit connecting said supply to said motor, means for displacing said actuating means under the action of the wheel, in opposition to the action of the spring, at least to a position in which said actuating means is locked by said locking means, means operative by subsequent rotation of said wheel for unlocking said locking means, means for opening said circuit and consequently stopping the rotation of the wheel, after the locking of said actuating means by said locking means, but before the unlocking of said locking means, and means connected to a control means for closing said circuit and consequently rotating said wheel.

2. A device according to claim 1, wherein said means for displacing said actuating means in opposition to the action of the spring comprise at least one tooth disposed on the periphery of the wheel and cooperative with a tooth rigid with the actuating means.

3. A device according to claim 2, wherein said cooperative teeth have conjugate profiles.

4. A device according to claim 1, 2 or 3, wherein said locking means comprise a lug rigid with said actuating means and a pawl mounted relative to the case to cooperate with said lug.

5. A device according to claim 4, wherein said means for unlocking said locking means comprise at least one tooth disposed on the periphery of said wheel and capable of engaging a head portion of the pawl and thereby urging back said pawl out of engagement with said lug.

6. A device according to any one of the claims 1 to 3, wherein said means for displacing said actuating means and said means for unlocking said locking means comprise a common tooth disposed on the periphery of said wheel.

7. A device according to any one of the claims 1 to 3, wherein the wheel comprises on one of the sides thereof an annular electrically conductive surface and said circuit comprises two electric contacts, one of which contacts is connected to said supply whereas the other contact is connected to a terminal of the motor, and said means for opening said circuit comprise on said conductive surface at least one non-conductive zone in the path of one of said electric contacts.

8. A device according to any one of the claims 1 to 3, comprising a device for suddenly stopping the motor by a shorting of terminals of the motor when said circuit is opened.

* * * * *